United States Patent [19]

Shumrak et al.

[11] 4,127,189

[45] Nov. 28, 1978

[54] PLASTIC FOOD CONTAINER

[75] Inventors: George K. Shumrak, Natick; Paul Davis, Swampscott, both of Mass.

[73] Assignee: Sweetheart Plastics, Inc., Wilmington, Mass.

[21] Appl. No.: 807,588

[22] Filed: Jun. 17, 1977

[51] Int. Cl.[2] ..... B65D 21/02; B65D 41/16; B65D 43/16

[52] U.S. Cl. ..... 206/520; 220/306; 220/339; 229/2.5 R

[58] Field of Search ..... 206/518, 519, 520; 220/70, 306, 339, 337, 72; 229/2.5 R, 29 M; 215/100.5

[56] References Cited

U.S. PATENT DOCUMENTS

| | | | |
|---|---|---|---|
| 2,036,572 | 4/1936 | Frost | 229/2.5 |
| 2,814,427 | 11/1957 | Emery | 229/2.5 |
| 2,852,157 | 9/1958 | Frater | 206/519 |
| 2,988,258 | 6/1961 | Witzke | 206/520 |
| 3,347,411 | 10/1967 | Kalata et al. | 206/519 |
| 3,442,420 | 5/1969 | Edwards | 206/520 |
| 3,511,433 | 5/1970 | Andrews et al. | 220/339 |
| 3,539,552 | 11/1970 | Mounts et al. | 206/519 |
| 3,876,130 | 4/1975 | Haase | 229/2.5 R |
| 3,935,962 | 2/1976 | Schubert | 220/306 |

FOREIGN PATENT DOCUMENTS

| | | | |
|---|---|---|---|
| 2,005,409 | 4/1969 | France | 206/520 |
| 301,596 | 10/1968 | Sweden | 206/520 |

*Primary Examiner*—William Price
*Assistant Examiner*—Allan N. Shoap
*Attorney, Agent, or Firm*—Wolf, Greenfield & Sacks

[57] ABSTRACT

In a foamed plastic food container having an integral dish and cover, triangular pedestals are formed in the bottom wall of the dish. The height of the pedestals is equal to the stacking height of the container to prevent compacting during storage. Channels between the pedestals allow air circulation about the food in the container to prevent the food from becoming soggy.

6 Claims, 4 Drawing Figures

Thus compression of the bun, which may damage it and/or cause hot juices to flow from it and thereby soil or burn the fingers is avoided during insertion and removal of the hamburger or other sandwich. Any fluid which does escape from the hamburger will flow to the bottom of dish 7 below the level of the supporting surfaces 17A–17D of the pedestals so that it does not soak into the bun. Channels 14 permit vapors escaping from bun 16 to dissipate from directly under the bun where the vapors could be trapped and detract from the appeal of the bun.

The nesting feature of the containers is shown in FIG. 4. As in conventional containers there is a lack of undercuts or reverse tapers. Therefore one container fits snugly into another. In addition the substantially vertical wall 11A of the container wall just below rim 11 creates stock thickness interference; i.e. it causes the lower side of shoulder 11B to contact the upper side of rim 11 over an area of a width approximately equal to the thickness of the material out of which the container is composed. Likewise on the cover the vertical skirt 12 causes stock thickness interference between the lower side 10B of rim 10 and the upper side of skirt rim 12A. This stock thickness interference prevents the containers from compacting and thus improves the stacking properties. The stacking height of the containers is equal to the effective height of wall portion 11A and skirt 12.

The pedestals also contribute to improve the stacking properties. Walls 18A–18D of the pedestals 5 are substantially vertical and their height is equal to the stacking height of the containers. The vertical nature of the walls creates stock thickness interference between the lower side of wall 7 and the upper side of surfaces 17A–17D at points 19A–19D. This prevents the upper container from being pushed down into the lower container, and thus leads to easier separation of the containers.

There has been described a novel deformable food container that provides for efficient insertion and removal of food such as hamburgers, improved food storage and container nesting properties, and having numerous other features. It is evident that those skilled in the art may now make numerous uses and modifications of and departures from the specific embodiment described herein without departing from the inventive concepts. For example, many shapes would be possible for the lower container providing it is not circular; and in fact if bun 16 were formed in a square shape then even a circular form for dish 2 would be possible. The size, shape and number of pedestals 5 can vary considerably. The container may be composed of any suitable materials such as pressed fiber, pulp, etc. rather than the preferred plastic foam. While the invention is disclosed in terms of an improvement in the foam container described the U.S. Pat. Application Ser. No. 764,033, it is equally applicable to any other deformable food container. Consequently the invention is to be construed as embracing each and every novel feature and novel combination of features present in and/or possessed by the improvement herein described.

What is claimed is:

1. A deformable food container nestable with identical containers when in the open position comprising a bottom dish and a cover interconnected by a hinge formed as an integral part of the dish and cover and made of a foam plastic material, said dish and cover having bottom and top walls respectively and each having tapered side walls that flare outwardly from the respective bottom and top walls, said side walls each terminating in a rim, a first stacking means formed at the rim of the cover and including a shoulder spaced below the rim and a substantially vertical wall joining the shoulder and rim, said substantially vertical wall causing interference between the shoulder and rim of the cover nested below it substantially equal to the thickness of the substantially vertical wall so as to provide a finite stack height for the cover when nested with the cover of an identical food container, a pedestal having substantially vertical side walls formed in the bottom wall of the dish and spaced from the tapered side wall for supporting food placed in the dish above the bottom wall, said pedestal having a height equal to the height of the stacking means in the cover and defining a second stacking means and having a finite stack height for the dish when nested with the dish of an identical food container equal to the finite stack height provided by the first stacking means in the cover, and latching means formed in the side walls of the dish and cover opposite the hinge, said latching means releasably locking the cover and dish in a closed position with the shoulder of the cover lying closely adjacent and below the latching means of the dish and the rim of the cover overlapping and abbutting the rim of the dish.

2. A deformable food container as described in claim 1 further characterized by said pedestal in the dish having substantially vertical side walls and a top wall, the vertical walls of the pedestal causing interference between the lower surface of the bottom wall of the dish and the top wall of the pedestal for a like dish nested below it substantially equal to the thickness of the vertical side walls of the pedestal.

3. A deformable food container as described in claim 2 further characterized by said pedestal comprising a plurality of separate pedestals in the bottom wall of the dish all spaced from the side walls of the dish and from one another to define troughs about the pedestals for circulating air about and collecting moisture from the food packaged in the container, siad pedestals also having flat top walls for supporting the food in the dish.

4. A deformable food container as described in claim 3 further characterized by each of said pedestals being generally triangular in shape and each having an outside edge substantially parallel in plan view to the side wall of the dish.

5. A deformable food container as described in claim 1 further characterized by said dish having a substantially square planar configuration providing room at the corners for the entry of the fingers of the user to insert or remove a food object supported on the pedestal in the dish.

6. A deformable food container comprising a bottom dish and a cover interconnected by a hinge formed as in integral part of the dish and cover and made of a foam plastic material,

PLASTIC FOOD CONTAINER

BACKGROUND OF THE INVENTION

The invention in general relates to foamed plastic food containers having an integral dish and cover interconnected by a hinge and capable of nesting in a stack when the containers are open. More particularly the invention relates to an improved dish for such containers which enhances the stacking properties and food storage capability of the container and provides for easy insertion and removal of foods in the dish.

Foamed plastic food containers are very widely used in the fast food industry because they are economical and permit food to be handled, stored, and reheated easily and conveniently.

The functional design of the foamed plastic food containers is well developed and includes many United States patents and patent applications. Among the most relevant are U.S. Pat. Nos. 3,876,130 and 3,935,962 and applicants' own earlier U.S. Pat. application Ser. No. 764,033, now abandoned, filed Jan. 31, 1977. These prior patents and applications generally relate to structures that permit efficient handling of the container before and after the food is placed in it. However, it is also important in the fast food industry that the operations of inserting and removing the food from the container be more quickly and efficiently performed. This is complicated by the fact that the typical hamburger sandwich is not assembled as precision article. The height and roundness of the buns vary. The hamburger meat itself is not completely round and when the sandwich is assembled, the meat patty is usually offset from the center.

Most containers used for hamburger sandwiches have a generally round shape and are only slightly larger than the hamburger. Furthermore, the hamburger usually rests on the bottom or very close to the bottom of the container. Such containers are so completely filled by the hamburger and bun that there is no room for the fingers while placing the hamburger in the container and while lifting it out of the container. All of these factors may cause burning or soiling of the fingers and/or crushing of the hamburger, especially when the hamburger is being handled very quickly. In addition, the close confines of the containers trap the vapors emanating from the hot hamburgers, with the result that the buns soon become soggy and unappetizing.

SUMMARY OF THE INVENTION

An important object of the invention is to provide deformable foamed plastic food containers that permit more efficient insertion and removal of sandwiches such as hamburgers, that preserve such food better during storage, that stack better than such prior art containers, that better display the sandwich packaged in them, and that compensate for the lack of uniformity of sandwiches to be packaged in them.

In accordance with this invention the food container of the type having a bottom dish and top cover interconnected by a hinge and adapted for nesting, has a plurality of pedestals formed in the bottom wall of the dish. The dish and cover are substantially square in plan view. The pedestals in the bottom wall of the dish and which support the food such as a hamburger off the bottom, in combination with the relatively square shape, provide room for the fingers to be inserted about and under the food without injury to the fingers or the hamburger.

Preferably the pedestals are of a height equal to the stacking height of the container as established by other stacking facilities in the container, which prevents compacting of a nested stack of the containers during storage. The substantial height of the pedestals provide for improved air circulation about the hamburger or other food, which helps to maintain it in a fresh, crisp condition.

Numerous other features, objects and advantages of the invention will be better understood and appreciated from the following detailed description when read in conjunction with the accompanying drawing in which:

DESCRIPTION OF THE PREFERRED EMBODIMENT

Figure 1:
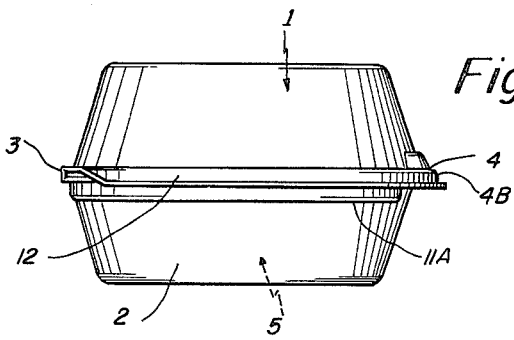
FIG. 1 is a side view of a closed container constructed according to this invention.
Figure 2:
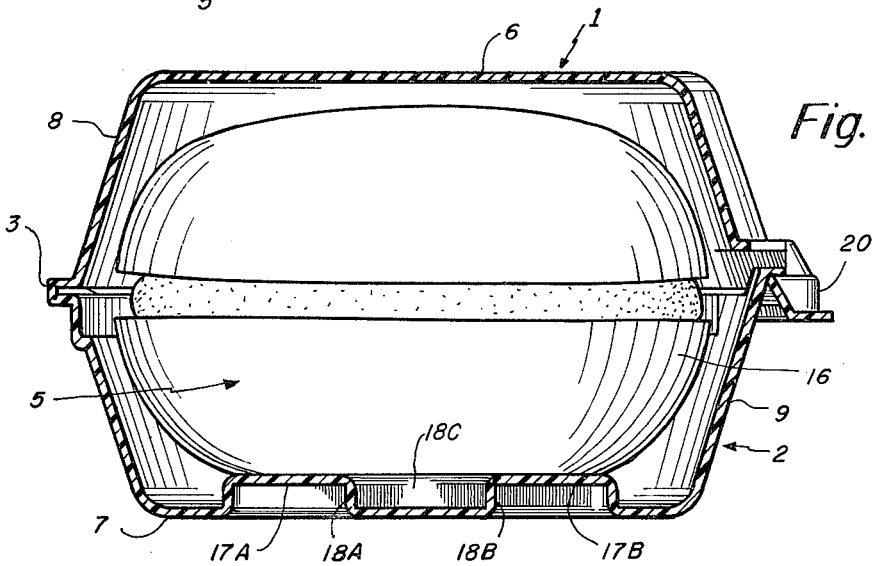
FIG. 2 is a cross-sectional view of the container of FIG. 1 shown on an enlarged scale and containing a hamburger.

FIG. 1 shows the container according to the invention in its closed position. It comprises a top cover 1, a bottom dish 2, interconnected by a hinge 3 at one end, and having a latching mechanism 4 at the other end. FIG. 2 shows a cross-section of the container with a hamburger 5 resting on pedestals in the dish 2.

Figure 3:
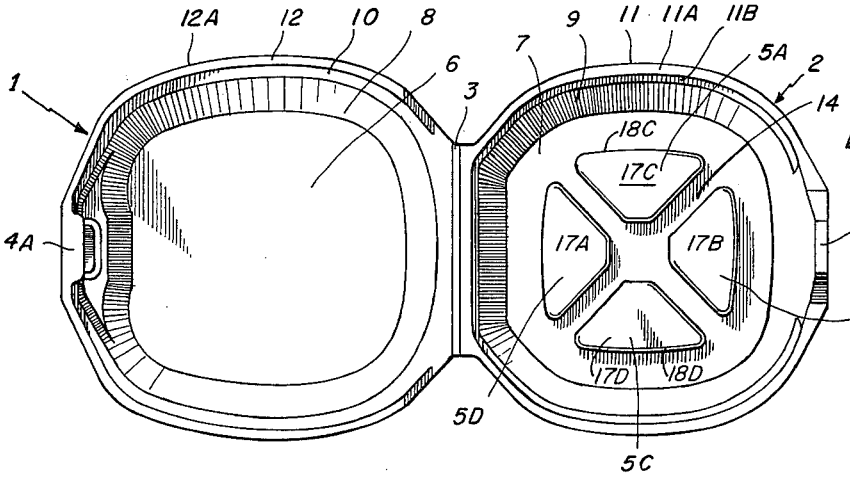
FIG. 3 is a top plan view of the container of FIG. 1 in the open position.
Figure 4:
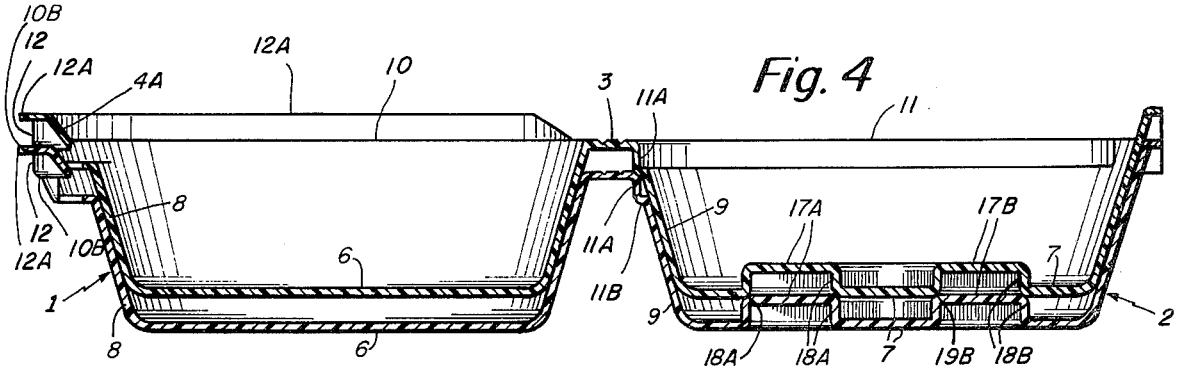
FIG. 4 is a cross-sectional view on an enlarged scale of two containers according to the invention showing the manner in which one nests within the other.

The container according to the invention is of one piece molded construction, as best shown in FIGS. 3 and 4 and is made of foamed plastic material. Cover 1 and dish 2 both have base walls 6 and 7, outwardly sloping side walls 8 and 9, and a latching mechanism composed of a female portion 4A and a male portion 4B. In the embodiment shown, side walls 8 and 9 terminate at their edges remote from their base walls in flared rims 10 and 11 respectively. The latching mechanism is as described in applicants' earlier application Serial No. 764,033, supra. The container may be closed by rotating cover 1 about hinge 3 toward dish 2 until rims 10 and 11 engage one another, at which point male portion 4B of the latching mechanism snaps into the female portion 4A. In the embodiment shown skirt 12 on the cover 1 overlaps the rim 11 of the dish 2 when the container is in the closed position.

The container according to the invention differs from prior art containers in that dish 2 is substantially square-shaped, and has a plurality of raised pedestals 5A, 5B, 5C and 5D formed in the bottom wall 7 of the dish. The pedestals are molded as integral parts of wall 7, as seen in FIGS. 2–4. The pedestals are separated by channels 14, and in the embodiment shown each pedestal is generally triangular in shape. The pedestals 5A–5D are spaced from the wall 9 of the dish 2 so that when a conventional bun 16 for a hamburger or other sandwich is inserted in the container there is room between wall 9, base 7, and bun 16 for the user's fingers (see FIG. 2). The substantially square shape of dish 2 makes the space for the fingers especially plentiful at the corners of the dish, where the fingers can easily be inserted along the side and slightly under the bun 16 in order to grasp it.

said dish and cover having bottom and top walls respectively and each having tapered side walls that flare outwardly from the respective bottom and top walls, said side walls each terminating in a rim, a first stacking means formed at the rim of the cover providing a finite stack height for the cover when nested with the cover of an identical food container, a pedestal formed in the bottom wall of the dish and spaced from the tapered side wall for supporting food placed in the dish above the bottom wall, said pedestal having a height equal to the height of the stacking means in the cover and defining a second stacking means and having a finite stack height for the dish when nested with the dish of an identical food container equal to the finite stack height provided by the first stacking means in the cover, and third stacking means, including a shoulder in the side wall, formed below the rim of the dish for engaging the rim of an identical dish nested with it providing a stacking height for the dish equal to the stack height established by the pedestal.

* * * * *